US005209002A

United States Patent [19]

Tranquilli et al.

[11] Patent Number: 5,209,002

[45] Date of Patent: May 11, 1993

[54] FRONT-END BUCKET ASSEMBLY FOR USE WITH 4-WHEEL DRIVE VEHICLE

[75] Inventors: Dominick R. Tranquilli, Basking Ridge; Greg H. Hamm, Parsippany; Stephen K. Quigley, Washington, all of N.J.

[73] Assignee: Transtar Truck Body and Welding Co., Inc., Califon, N.J.

[21] Appl. No.: 747,624

[22] Filed: Aug. 20, 1991

[51] Int. Cl.[5] ..... E02F 3/28

[52] U.S. Cl. ..... 37/442; 37/231; 172/273

[58] Field of Search ..... 37/231, 264, 118 A, 37/241, 117.5, 118 R; 414/703, 723, 920, 686; 172/273, 272

[56] References Cited

U.S. PATENT DOCUMENTS

| | | | |
|---|---|---|---|
| 1,920,475 | 8/1933 | Meyer | 37/231 |
| 2,827,183 | 3/1958 | Wagner et al. | 37/117.5 |
| 2,993,608 | 7/1961 | Womble | 37/117.5 |
| 3,034,234 | 5/1962 | Wolfe et al. | 37/118 R |
| 3,187,912 | 6/1965 | McKnight | 414/703 |
| 3,208,611 | 9/1965 | Robnett | 37/117.5 X |
| 3,512,665 | 2/1968 | Westendorf | 172/273 |
| 3,760,883 | 9/1973 | Birk | 37/231 |
| 3,913,768 | 10/1975 | Groos et al. | 414/723 X |
| 4,274,213 | 6/1981 | Yadlowsky | 37/117.5 |
| 4,304,056 | 12/1981 | Watson | 37/231 |
| 4,383,793 | 5/1983 | Weir | 37/117.5 X |
| 4,421,449 | 12/1983 | Cotton | 414/685 |
| 4,439,939 | 4/1984 | Blau | 37/231 |
| 4,890,400 | 1/1990 | Long | 37/117.5 |
| 4,962,598 | 10/1990 | Woolhiser et al. | 37/117.5 |
| 4,963,071 | 10/1990 | Larwin et al. | 414/723 |
| 4,976,053 | 12/1990 | Caley | 37/231 |
| 5,036,607 | 8/1991 | Taylor | 37/117.5 X |

*Primary Examiner*—Dennis L. Taylor
*Assistant Examiner*—Arlen L. Olsen
*Attorney, Agent, or Firm*—Klauber & Jackson

[57] ABSTRACT

A bucket and H-frame assembly is described which is adapted for use with 4-wheel drive, truck and military and pick-up vehicles. The bucket is designed to contain approximately 600 pounds of material and is ideally suited by landscapers and light contractors. The H-frame assembly is comprised of a pair of H-beam-push arms which are pivotally attached to the bucket. Cross-beams are welded to the H-beam push arms and together form a plane. A tilt adjusting piston is pivotally attached to the H-frame and the arm of the piston is attached to the bucket. To protect the piston from damage during use, piston guards are attached to the front cross-beam extending above the plane defined by the H-beam push arms and cross-beams. These guards protect the piston from contact with the bottom surface of the bumper of the vehicle when the assembly is raised. The assembly further utilizes a pair of adjustable pivotally-mounted ears which cooperate with an attachment means on the vehicle chassis.

8 Claims, 7 Drawing Sheets

FRONT-END BUCKET ASSEMBLY FOR USE WITH 4-WHEEL DRIVE VEHICLE

BACKGROUND OF THE INVENTION

The invention described herein relates to a front-end bucket loader for use with conventional 4-wheel drive trucks and off-road vehicles. Front-end loaders have been used for years to move bulk materials, such a dirt, sand, etc. Typically, the loader is attached to a dedicated vehicle and is not removable from the vehicle. Hence such vehicles have always been very expensive and available only to construction and excavation professionals.

Snow plows have been used with 4-wheel drive vehicles, trucks and the like. Typically, the frame used to attach a snow plow to a truck (such as an A-frame) does not provide adequate stability or strength to support a load, and is instead only useful to control the angle of the blade. Additionally, a separate motor driven piston is used to raise and lower the blade to accommodate variations in the terrain.

Hence, one object of the present invention is to provide a bucket front-end loader and frame assembly which is suitable for use with a conventional adapter attachment which is mounted on the vehicle.

Another object of the invention is a front-end bucket type loader which is light weight and of sufficient strength to enable the operator to push-load and carry material weighing up to about 600 pounds.

Additionally, an object of the invention is to provide an H-frame assembly which demonstrates excellent stability and load-carrying capacity, and is adaptable to use with any conventional frame attachment means which is mounted on the vehicle.

Another object of the present invention is to provide dump-bucket assembly that can be used with conventional four-wheel drive vehicles, trucks, light military vehicles and the like.

Another object is to provide a dump bucket assembly which is easily attached to the vehicle by the operator of the vehicle, using a pair of mounting brackets which are attached or otherwise present on the vehicle.

Another object is to facilitate the easy movement or removal of bulk materials, such as sand, dirt, mulch and the like.

These and other objects will be apparent to those of ordinary skill in the art from the teachings herein.

U.S. Pat. No. 3,512,665 issued to Westendorf, relates to an attachment means for front-end loaders. The bucket has on its back surface a pair of V-shaped channels which connect to the front-end loader via a pair of hydraulically activated V-shaped plates. The angle of the bucket is hydraulically modifiable to allow for tilting.

U.S. Pat. No. 3,760,883 issued to Birk, relates to a quick hitch assembly for connecting and disconnecting various attachments to a vehicle. The assembly utilizes a vertically-mounted hydraulic cylinder which raises and lowers a horizontal support bar, while in turn engages an upper portion of a hook assembly. Additionally, a pair of hydraulic cylinders is present which can be activated to tilt the assembly.

U.S. Pat. No. 4,304,056 issued to Watson et al., relates to a snow plow mounted on a vertical frame which is secured to a vehicle and a horizontal frame which attaches to the vertical frame.

U.S. Pat. No. 4,421,449 issued to Cotton, relates to a forklift attachment for a vehicle, comprised of a lift mounted on the front, a cross-frame member and a pair of tongues having one end attached to the cross-frame member and an opposite end arranged to pivotally connect to the vehicle chassis. A number of tines is also included, each having an end bracket which enables the tines to engage the cross-frame member.

U.S. Pat. No. 4,439,939, issued to Blau, relates to a snow plow for use with small vehicles, such as cars. The snow plow includes a quick coupling system and a hydraulic system mounted on the plow support frame or to a sub-frame assembly which is attached to the car.

U.S. Pat. No. 4,890,400 issued to Long, relates to an attachment which forms a "four into one" type dump bucket when attached to a snow blade. The bucket attachment is pivotally mounted when used in combination with the blade. The bucket assembly and snow blade can be used in a closed position to contain dirt, sand, etc., and can be opened at the rear to deposit the transported material.

U.S. Pat. No. 4,976,053 issued to Caley, relates to an adapter which has open jaws which are upwardly inclined and which direct an attachment plate into a retaining slot.

None of the patents described above utilizes an H-shaped frame in connection with a bucket, which is useful for attaching the dump bucket to a 4-wheel drive vehicle or light truck. Additionally, none of the patents described above relates to a frame which adds substantial stability to the equipment piece when in use. Moreover, none of the patents provide a bucket with an optimally designed bucket which causes the load to churn or roll within the bucket as it is push-loaded, thereby avoiding packing in the corners of the bucket.

SUMMARY OF THE INVENTION

A bucket and frame assembly are described herein. The H-shaped frame is comprised of a pair of H-beam push arms, which are adapted at the front thereof to cooperate with the attachment means of a bucket. The H-beam push arms are generally parallel with each other and align in the direction of the vehicle to which said H-frame is attached when in use. The H-beam push arms are connected to each other by a front cross beam and a rear cross brace. Each is generally perpendicular to the H-beam push arms and welded to the H-beam push arms. Additionally, mounted on the rear cross brace and running generally parallel to the H-beam push arms is a pair of connecting ears which attaches the H-beam assembly to a pair of chassis mounted brackets on the vehicle during use.

BRIEF DESCRIPTION OF THE DRAWINGS

The invention is described in detail in connection with the accompanying drawings, in which.

DETAILED DESCRIPTION

Figure 1:
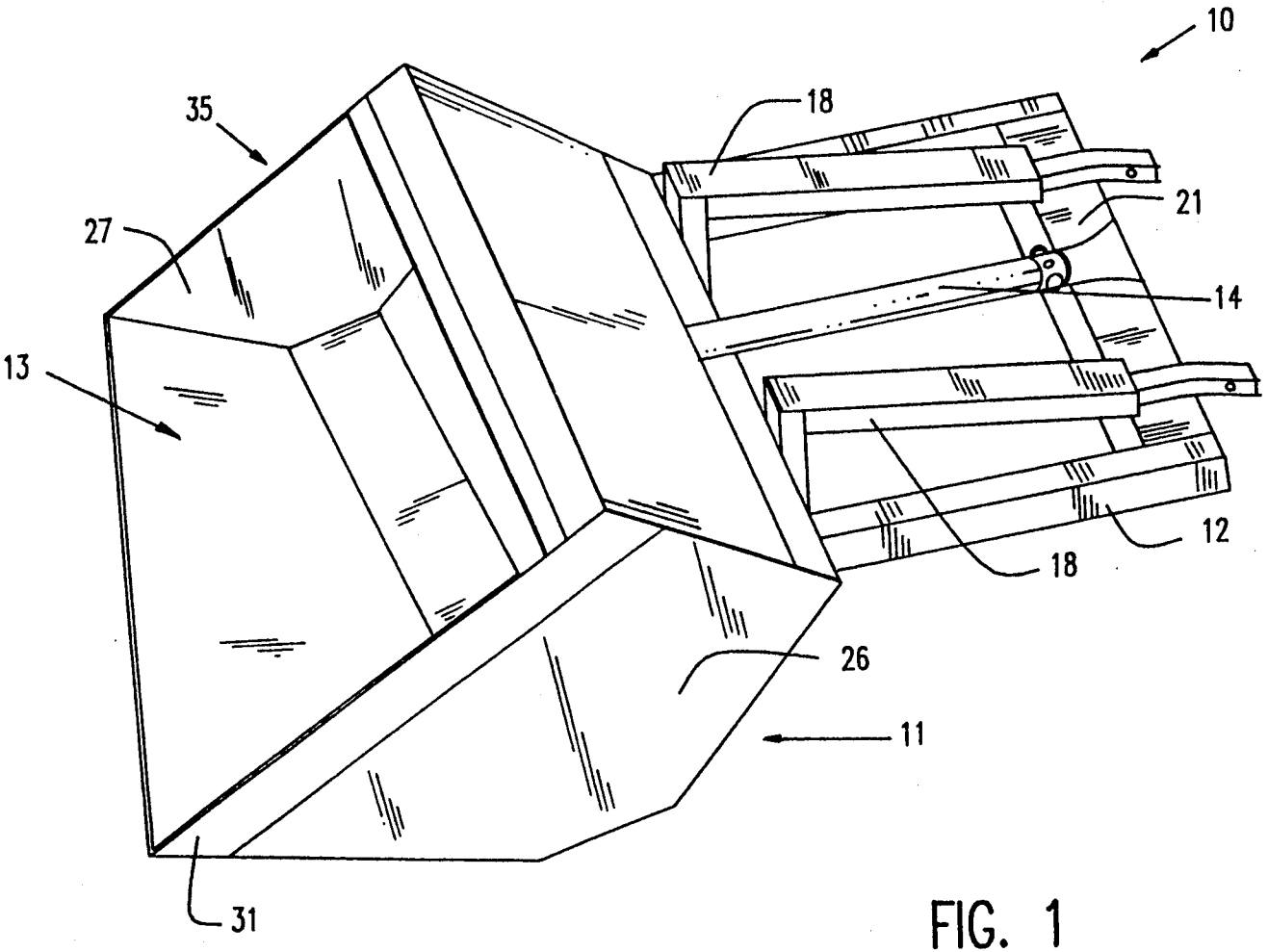
FIG. 1 is a perspective view of the H-frame and bucket attached thereto.
Figure 2:
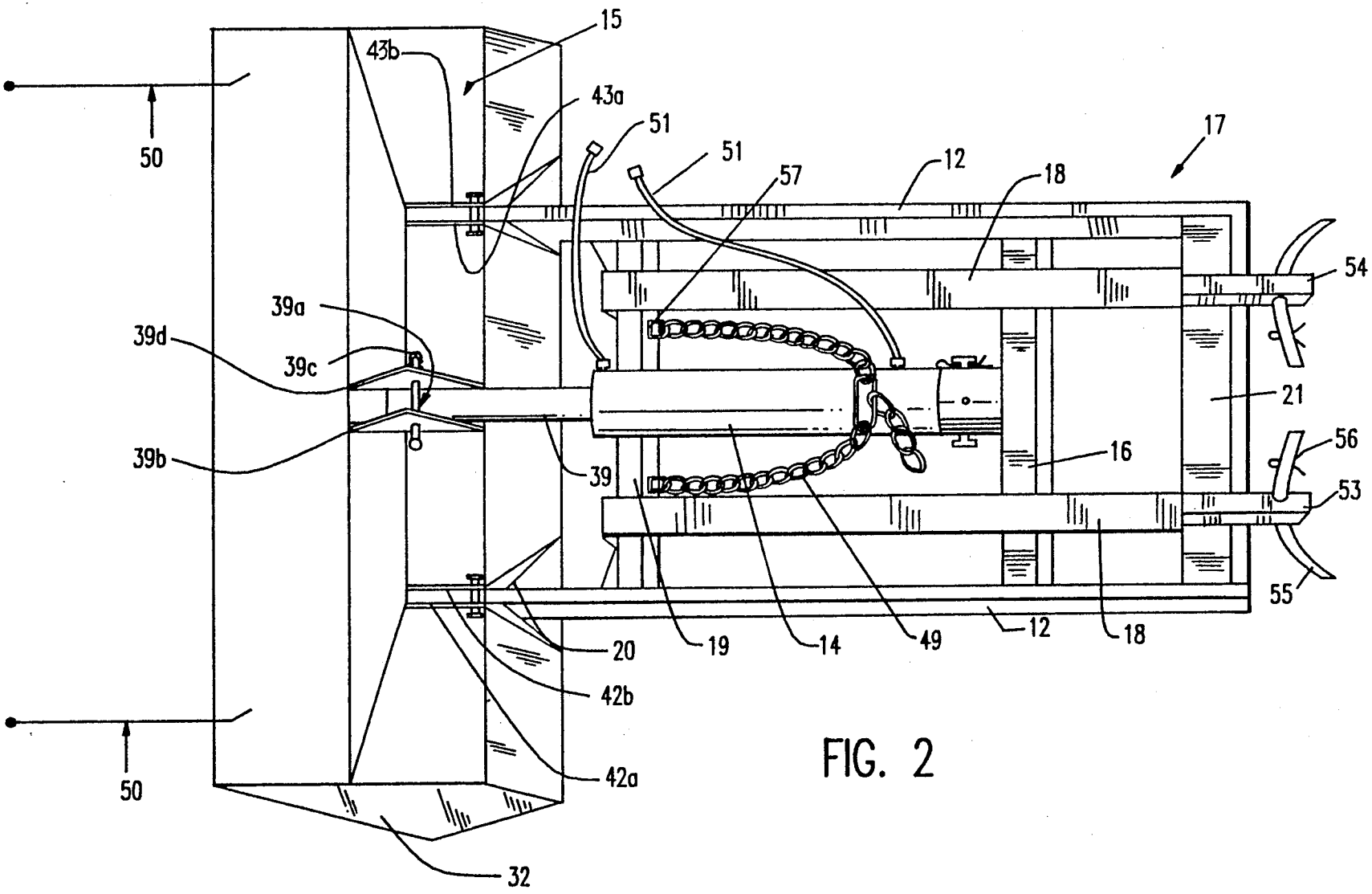
FIG. 2 is a downward view of the H-shaped frame without the vehicle present, with an optional middle cross-beam present and with the bucket tilted forward
Figure 3:
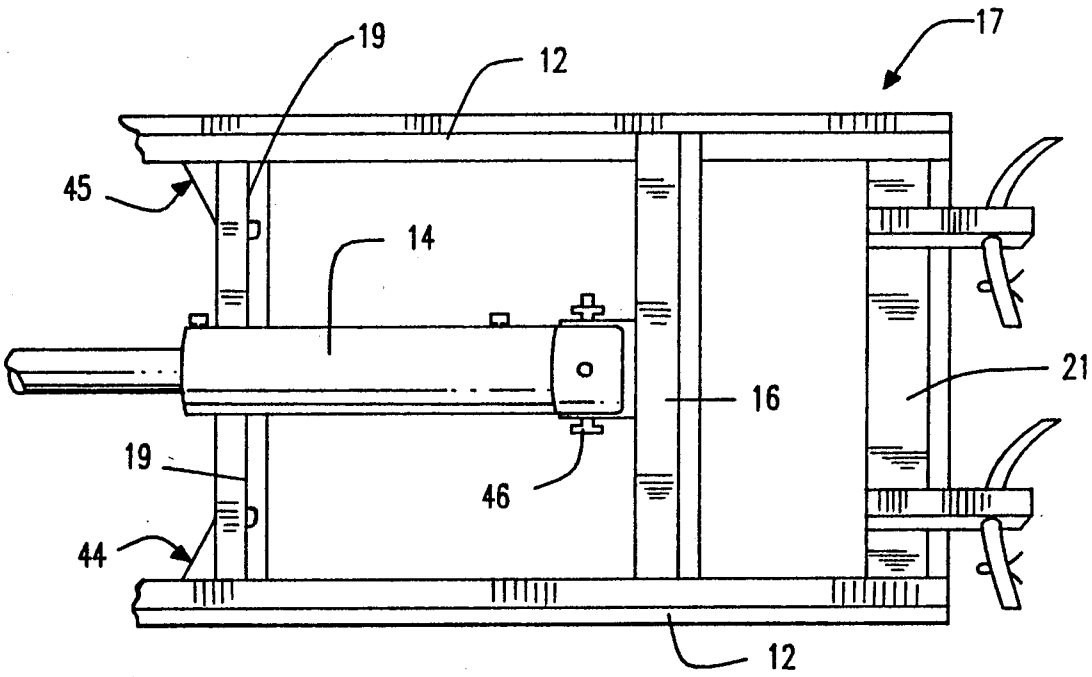
FIG. 3 is a simplified downward view of the H-frame with the bucket and vehicle removed.
Figure 4:
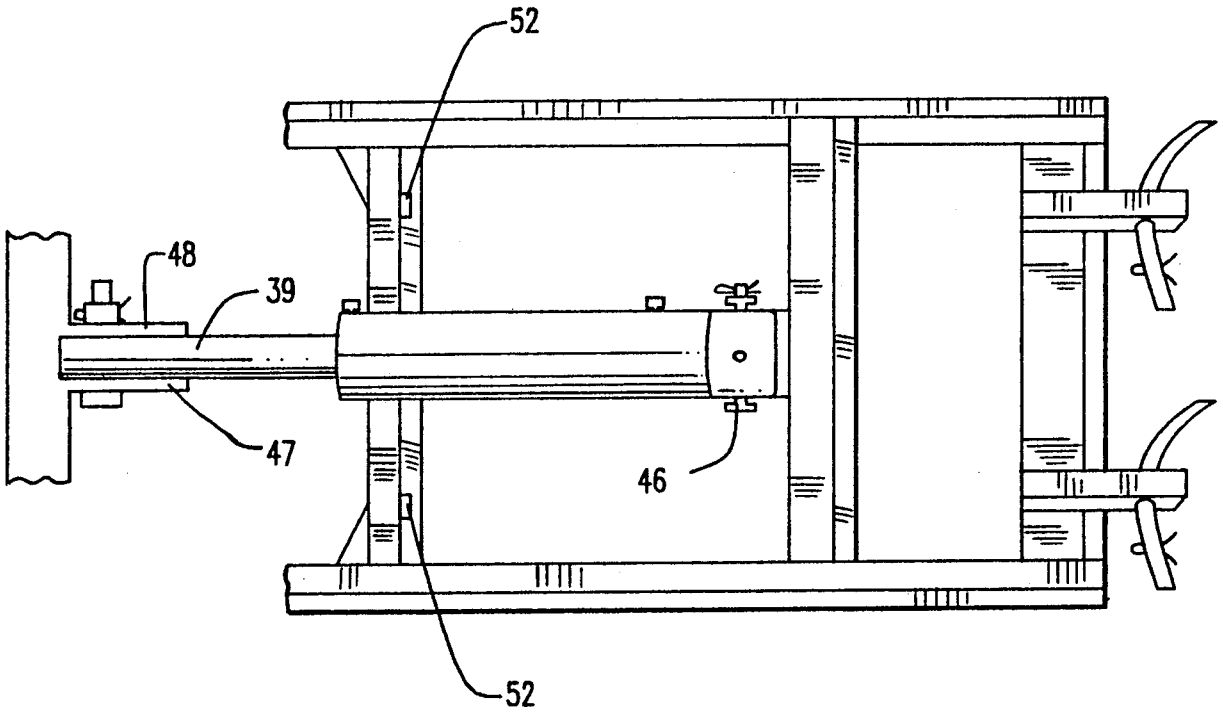
FIG. 4 is a downward view of the H-frame with the tilt piston arm extended.

As shown in detail in the drawings, the invention shown generally as 10 encompasses a bucket 11 which is pivotally attached to a pair of H-beam push arms 12 and situated such that the mouth 13 of the bucket faces forward during push-loading and is adjustably tilted forward at an angle such that the mouth of said bucket is effective for loading bulk material and containing said bulk material when the bucket is tilted rearward and raised. The vehicle can then be driven at low speed, e.g., 5 mph, off-road, to transport material, or at slightly higher speeds "on road" when the bucket is empty.

The bucket described herein is preferably comprised of weldable material, such as steel, and is of sufficient strength to avoid unnecessary dents or wear during use. The most preferred material is ⅛ inch thick mild steel. This is particularly preferred in that it is light weight and strong.

The bucket is preferably about 4 feet wide, but can be about as wide as a conventional snow plow, for example, up to about 6 to 7 feet wide, in which case the maximum load may be higher. However, the preferred width is about 48–49 inches.

The bucket is typically comprised of a front panel 22, a rear panel 23, a load dispersing panel 24, a bottom panel 25 and left and right side panels 26 and 27 respectively. As will be apparent, the designations front, bottom and rear identifying the panels are relative, since the bucket tilts forward to dump the contents and backward to contain the material, changing the panels which are actually at the front, bottom and rear. Therefore, these relative designations are only for purposes of identification.

Preferably the front, load dispersing, bottom and rear panels are fabricated from a single piece of material. This is preferable for purposes of mass production, reducing the number of manufacturing steps and reducing the number of welds required. Additionally, a single sheet of steel can be configured around a mold of the bucket, and the angles formed by bending or otherwise shaping the steel sheet around the mold. To make a preferred bucket using the preferred process, a ⅛ inch cold rolled steel sheet having the appropriate length (about 54–56 inches) is bent into a blank while heated to conform to the angles described below.

The front panel is typically about 12 to 18 inches high, most preferably 15 to 16 inches high, and as wide as is appropriate, most preferably about 48 inches as described above, as shown in FIG. 5. At the top of the front panel 22 is an optional front wear bar 28. This is preferred since it protects the front panel during use and enables the bucket to be used for grading or scraping when dragged forward or backwards. The front wear bar 28 is preferably of somewhat harder steel than the bucket panels, since this protects the main point at which the bucket will tend to wear over time. Most preferably the front wear bar is about 3 inches wide and again about 48 inches long to protect the front panel along its entire width. It is most preferably comprised of ⅜ inch thick high-tensile strength wear-bar steel, having a Brinell hardness of about 360–400 and a tensile strength of about 177,000 to about 202,000 psi. The front wear bar is typically step seam welded to the front panel, and generally all welds made herein are step seam welds using ER 70,000 tensile strength welding wire.

The load dispersing panel 24 is typically attached to the front panel at an angle (b) which is effective for causing bulk material to disrupt and disperse within the bucket as it is push-loaded. Most preferably the load dispersing panel and the front panel form about a 140°–150° angle when viewed from the side or measured from the inside of the bucket. This assists in later unloading or dumping the bucket, since the contents are not packed into the bucket during the push-loading process.

The load dispersing panel 24 is typically about 6 inches high and is as wide as the front panel. It can be comprised of the same mild steel as the front panel.

The bottom panel 25 and rear panel 23 are also of the same width as the front panel and are typically comprised of the same material as the front and load dispersing panels. The bottom panel is typically about 12 to 13 inches from front to back, most preferably 12½ inches, and the rear panel is about 16 to 18 inches front to back, most preferably 16¾ inches.

To maximize disruption of the bulk material as the bucket is push-loaded, angle (c) which is the angle between the load dispersing panel 24 and bottom panel 25 is effective in combination with angle (b) for disrupting the contents of the bucket during push-loading. Most preferably angle (c) is about 140° to 150°.

Figure 5:
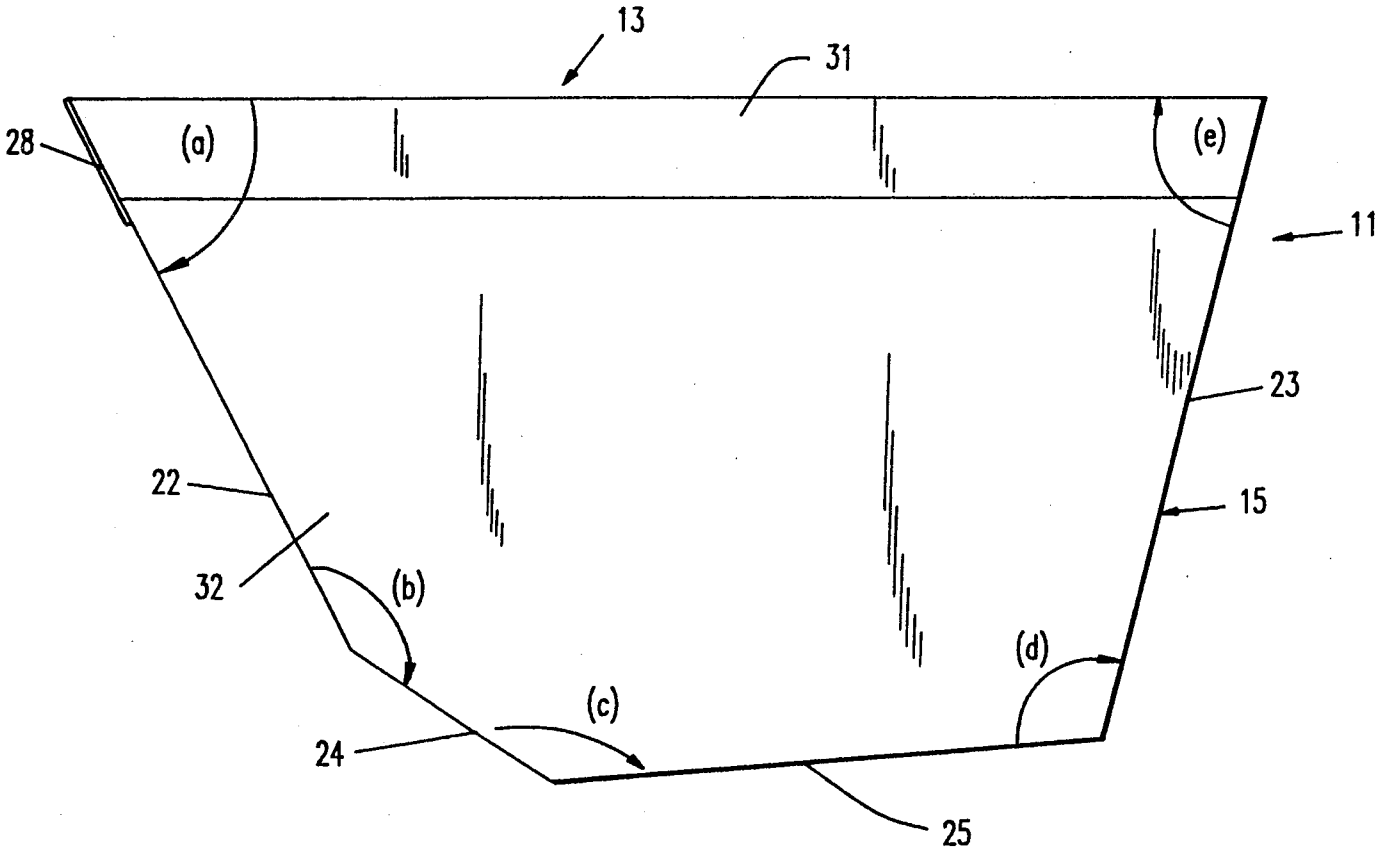
FIG. 5 is a cross-sectional view of the bucket.
Figure 6:
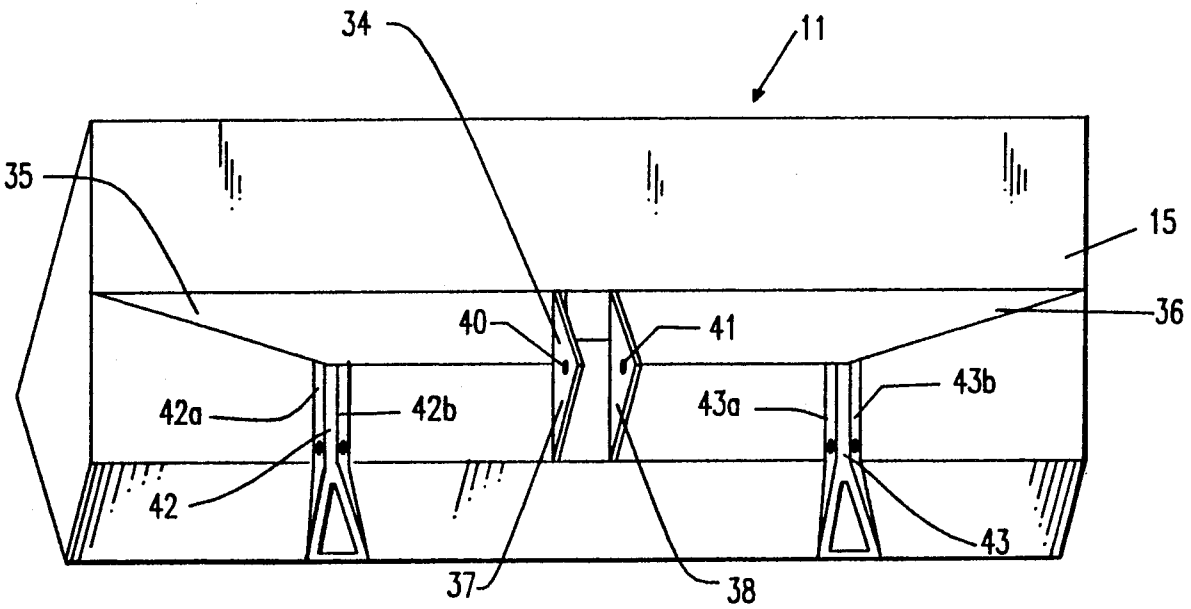
FIG. 6 is a rear-view of the bucket without the H-frame present.

The angle between the bottom and rear panels 25 and 26, angle (d), is effective for propelling the contents of the bucket forward slightly as the bucket is push-loaded. Hence, the preferred angle (d) is about 105 degrees, measured from the inside as described above. As shown in FIG. 5, the most preferred combination of bucket angles is as follows: angle (a) is optimally 70 degrees, angles (b) and (c) are optimally 145 degrees each, angle (d) is optimally 105 degrees, and angle (e) is optimally slightly less than about 90 degrees. This is the most preferred combination of angles, and is most effective for disturbing the bulk material as it is loaded. When this preferred combination of angles is used, a churning motion is seen inside the bucket as it is push-loaded when viewed from the front by a spectator, as in FIG. 7. Almost no packing occurs inside the bucket.

The bucket is further formed by attaching left and right side panels 26 and 27 respectively. These panels preferably conform to the angles described above, as shown in FIG. 5. The side panels are typically attached at the edges thereof to the other panels by a continuous inside weld.

Additionally, side wear bars 31 may be attached to protect the non-welded edges of the side panels, 32 and 33. The side wear bars need not be as heavily protective as the front wear bar, since wear and tear at the sides is not as great as at the front edge, and a lighter gauge steel can be used; however the side wear bars can be comprised of the same material as the front wear bar, as appropriate.

Preferably the side wear bars are comprised of 2" wide × ¼" high tensile wear bar steel which is welded to the upper edge of each side panel.

Optionally a wear bar or flange can be placed on the top edge of the rear panel if desired to increase support.

The bucket, when configured as described above, can contain a load of bulk material up to almost 600 pounds. Most preferably, when the bucket is about 48 inches wide, the maximum load is about 600 lbs.

Attached to the rear surface 15 of the bucket 11 is a piston mounting brace 34 having left and right lateral support members 35 and 36 respectively, and left and right perpendicular members 37 and 38 respectively. The lateral support members 35 and 36 are typically comprised of mild steel and are sized to provide lateral support and stability for the bucket. Preferably, each is about ⅛ inch thick, about 2 inches wide and about 21 to 24 inches from left to right.

The left and right perpendicular members 37 and 38 are also typically about 3/16 inch thick steel, and of sufficient perpendicular length (relative to the lateral support members) to provide adequate support for the bucket and stability during use.

The bucket is tilted forward and backward with a tilt adjusting piston 14, which is part of the activating assembly as described below.

The forward end 39*a* of the tilt piston rod 39 is attached to the perpendicular members 37 and 38 by means of a pivotable joint. Therefore, adequate protection from friction at the pivot point can be provided. The preferred means of pivotal attachment is a pin 39*b*, such as a long shank bolt with a short thread, a safety grade nut 39*c* and a cotter pin 39*d* which cooperate with the perpendicular left and right side bracket holes 40 and 41.

Affixed to the rear surface 15 of the bucket, and below the left and right lateral support members 35 and 36 are left and right H-beam attachment mounting brackets 42 and 43. Each H-beam attachment mounting bracket is essentially perpendicular to the lateral support members 35 and 36, and is comprised of left and right plates 42*a*, 42*b* and 43*a* and 43*b*, respectively. The left and right H-beam attachment mounting brackets are typically comprised of 3/16 inch thick steel; each has a pair of aligned holes or similar means which accomodate a pivoting mounting means, such as a pivot pin or short-thread bolt, which is fastened with a safety nut and cotter pin to the rear surface of the bucket as described above. It is preferable to use compatible pivot assemblies throughout on the rear surface of the bucket for optimal maneuverability, stability and ease in assembly use or repair.

The H-beam assembly which is attached to the rear surface of the bucket is comprised of a pair of H-beam push arms 12 the forward end of each being pivotally attached to the rear surface of the bucket by means of the left and right H-beam attachment brackets 42 and 43, respectively. The H-beam push arms are typically comprised of rectangular steel tubing, and are about 30 to 40 inches long. The most preferred tubing is 1½"×3"×3/16" thick. The overall length of the beam push arms can be varied within a range sufficient to situate the bucket assembly in front of the vehicle, without being so long as to lose strength or leverage when a loaded bucket is raised for transport, or to cause the vehicle to lose traction in the wheels. The preferred H-beam push arms are 30 to 38 inches long and about 27 inches apart, depending on the size of the bucket.

The H-beam push arms are connected to each other by a plurality of cross-beams which includes a front H-beam cross-bar 19, and a rear cross-brace 21. Each is about 24 to 27 inches long, depending on the thickness of the H-beam push arms.

The front cross-beam 19 is typically comprised of rectangular steel tubing like the H-beam push arms (1½"×3"×3/16" thick) for added support.

Left and right H-beam corner gussets, 44 and 45 respectively, can optionally be included to add torsional rigidity, and when included are preferably comprised of plate steel (2"×2"×⅜" thick). The corner gussets are continuous step seam welded or otherwise attached to the H-beam push arms and front cross-beam.

An optional middle cross-beam 16 can be included, which is preferably perpendicular to the H-beam push arms and comprised of square steel tubing (3"×3"×3/16") thick.

The rear cross-brace 21 is likewise perpendicular to the H-beam push arms and is preferably comprised of an L brace (3"×3"×⅜" thick). This "L" brace is preferably welded to the rear ends of each of the H-beam push bars, thus forming a rigid rectangular configuration, taking into account the push beams and cross pieces.

A pair of piston guards 18 can also be included in the H-beam assembly, which are generally parallel to the H-beam push arms when viewed from above. The piston guards are mounted on the front H-beam cross-bar 19 at the forward end 20. The piston guards project vertically upward from the front H-beam crossbar and run in the rearward direction generally parallel to each other. The piston guards are effective for preventing contact between the tilt adjusting piston barrel and the vehicle bumper when the H-shaped frame is raised.

For the piston guards to be effective, each extends vertically above the piston barrel and above the lateral plane defined by the H-push beams and cross pieces a sufficient distance to protect the barrel of the tilt adjusting piston 14 from damage due to improper elevation, which could cause collision between the piston barrel and the bumper of the vehicle (not shown). The piston guards are angled or curved when viewed from the side and are typically comprised of angled steel (2"×3/16" thick) such that they can be welded to the front H-beam cross-bar and the rear cross brace. This is shown most clearly in FIG. 1.

An optional safety spring can be used to control the angle of the bucket in the event that the tilt piston fails. The preferred safety spring has a strength of about 350 lbs. When used, it is typically attached to the H-beam push arm and to the rear surface of the bucket, preferably above the left H-beam push arm pivotal attachment.

An activating assembly is also included, which is comprised of a tilt-adjusting piston 14 which is generally parallel to the H-beam push arms when viewed from above. The forward end of the piston rod is pivotally attached to the bucket at the rear surface 15 thereof through the piston arm attachment 34, and the rearward end of the piston body is fixedly attached to the middle cross-bar 16 of the H-shaped frame 17. The piston can be activated hydraulically or can be electrically driven. When in the contracted position, the piston is effective for tilting the bucket backward and the bucket mouth 13 upward, to contain any bulk material which has been push-loaded into the bucket. When the piston rod is extended, the bucket is tilted forward and any bulk material contained therein can be dumped.

The preferred piston used for adjusting the tilt of the bucket is a double-acting piston having a piston throw which is of sufficient distance to tilt the bucket forward to dump material contained in the bucket, as well as backward a distance sufficient to contain any material which is push-loaded.

The piston arm 39 of the tilt adjusting piston is pivotally attached to the rear surface of the bucket as described above. The rear end of the piston barrel is mounted in a rear piston-mounting gusset 46. The piston operates above the front H-beam crossbar and above the plane defined by the H-frame. The rear piston mounting gusset 46 fixedly attaches the rear end of the piston barrel to the middle crossbar or rear cross-brace, such that activation of the piston with the arm going in a forward direction tilts the bucket forward causing the bucket to dump. Conversely, compression of the piston and retraction of the piston arm causes the bucket to tilt backward. Tilt adjusting piston 14 can be an electrically activated piston or a pneumatic-type piston which uses a hydraulic hose attached to the body thereof and connecting to an air pump (not shown). The most preferred piston operates at approximately 2500 psi, having a rod which is 1¼" in diameter and a barrel which is 2" in diameter.

Mounted on the rear cross brace is a pair of left and right ears 53 and 54, situated in a position which will cooperate with a pair of attachment means (not shown) which are mounted on the chassis of the vehicle. Typically, the attachment means is suited for the attachment of other implements to the vehicle as well, such as a snow plow. Consequently, it is contemplated and within the scope of the invention that the ears can be located wherever appropriate on the rear cross-brace 21 to correspond to the pre-existing attachment means on the chassis of the vehicle. For example, the left and right ears can be located and welded in the desired position after taking a few simple measurements to locate the relative positions of each attachment means on the vehicle.

Each of the left and right ears has a bore therethrough running laterally which aligns with the attachment means on the vehicle. To attach the ears to the attachment means, the ears are simply placed into the sleeve of each attachment means, the bore of each ear is aligned with the holes present through the attachment means, and a suitable pivotally-mounted attachment is made, such as with a bolt or pin 55 which is held in place with a nut and/or cotter pin 56 as described above.

By pivotally attaching the ears to the attachment means of the vehicle, the bucket and H-frame assembly may be raised or lowered as appropriate, pivoting on the pivotally attached ears.

Figure 7:
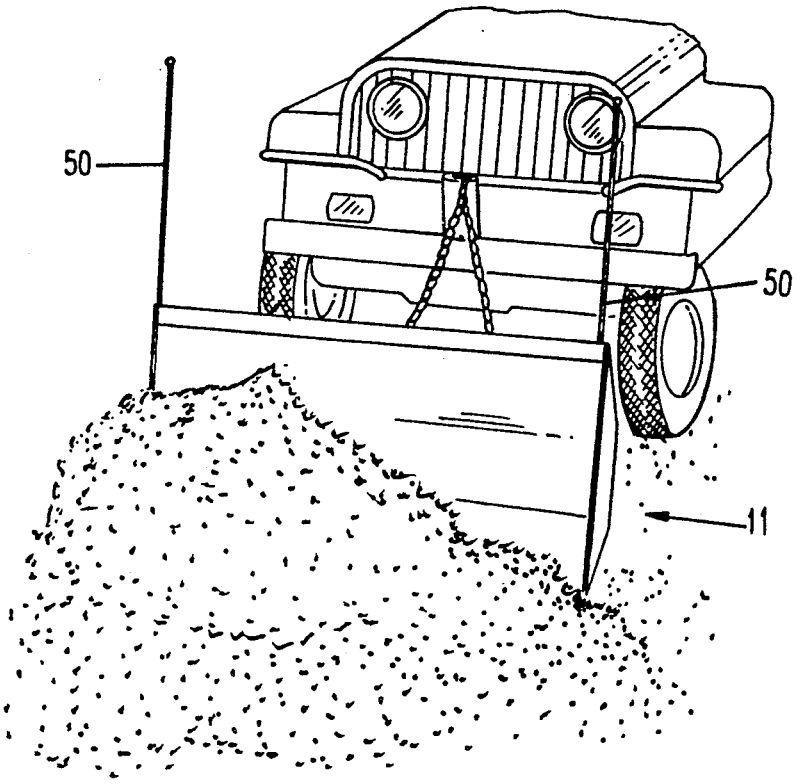
FIG. 7 is a perspective view of the dump bucket attached to the front of a vehicle.

Raising and lowering the bucket and H-frame assembly is typically accomplished with a second piston mounted on the front of the vehicle as shown in FIG. 7. This piston operates vertically and is usually angled forward to provide the proper leverage for raising and lowering the bucket and H frame assembly. An existing plow motor, electrically or hydraulically driven can be used to extend the vertical piston arm upward to thus raise the bucket.

The end of the vertical piston arm is typically attached to a chain 49 which in turn attaches to the piston guards, such as with a conventional U-bolt 57. A 5/16" chain is most preferred. Vertical pistons having an 8" to 12" throw are optimal for providing sufficient vertical lift. Preferably, sufficient vertical lift is provided to lift the lowermost portion of the bucket while it is in the "rearward tilted" position, to provide at least the same ground clearance as the vehicle.

Optional front end guides 50 can be attached to the rear panel of the bucket in the corners adjacent to the mouth, as shown generally in FIG. 7.

When in use, the front panel is essentially resting on the ground as the bucket is push loaded and the rear panel is facing upward. Front end guides affixed in this fashion make it easier for the operator to judge the relative position of the bucket during use.

Also optional are grease fittings (not shown) which can be located at the various pivot points on the rear surface of the bucket.

While the invention has been described in connection with the preferred embodiment thereof, numerous alternative embodiments are possible and within the scope of the claims. Consequently, the claims are not to be limited thereby.

What is claimed is:

1. An H-shaped frame assembly for attaching a bucket having a rear panel to a vehicle, comprised of a pair of push beam arms generally parallel to each other, each push beam arm having a front and rear end, each front end being pivotally attached to the rear panel of said bucket;

a front H-beam cross beam, and a rear cross-brace, each of said front cross-beam and rear cross-brace being substantially perpendicular to the H-beam push arms and rigidly attached to the H-beam push arms to define a plane;

said front H-beam cross beam spaced rearwardly from said front ends of said H-beam push arms to facilitate the tilting of said bucket over the front ends of said push arms; and a pair of ears mounted directly on the rear cross-brace in a position effective for cooperating with a pair of attachment means mounted on the chassis of a vehicle during use.

2. An H-frame assembly in accordance with claim 1 further comprised of a chain attached to the front H-beam cross beam and which is adapted to be raised by means of a piston.

3. An H-frame assembly in accordance with claim 1 wherein the ears cooperate with a pair of brackets on a vehicle during use, said ears being pivotally mountable in said brackets.

4. An H-frame assembly in accordance with claim 1 wherein the middle cross beam is adapted to support a bucket-tilt adjusting piston.

5. An H-frame assembly in accordance with claim 4 wherein the middle cross beam is in the plane defined by the front H-beam cross beam, the rear cross-brace and the H-beam push arms.

6. An H-shaped frame assembly for attaching a bucket to a vehicle, comprised of a pair of push beam arms generally parallel to each other, each push beam arm having a front and rear end, each front end being pivotally adapted to attach to a bucket;

a front H-beam cross-beam, and rear cross-brace being substantially perpendicular to the H-beam push arms to define a plane;

a pair of ears mounted on the rear cross-brace in a position effective for cooperating with a pair of attachment means mounted on the chassis of a vehicle during use, and a pair of guard arms vertically mounted on the front H-beam and extending above the plane defined by the assembly.

7. An H-frame assembly in accordance with claim 6 wherein the guard arms are vertically mounted on the front H-beam cross beam and extend above the plane defined by the assembly and rearwardly back to the rear cross brace where the guard arms fixedly attach to the rear cross brace.

8. A bucket and H-frame assembly comprised of:

(a) a bucket having the front panel, an angled front panel, a bottom panel, a rear panel and a pair of side panels; a plurality of pivotable attachment points on the rear panel, said panels being joined to each other in a combination of angles effective for inhibiting packing of the bucket upon push-loading;

(b) an H-frame assembly comprised of a pair of H-beam push arms, each being pivotally attached to said bucket at pivotal attachment points on the rear panel of the bucket;

a front cross-beam attaching said H-beam push arms to each other and perpendicular to said H-beam push arms;

a rear cross-brace perpendicular to and attached to said H-beam push arms at the rear end thereof;

said H-beam push arms, front H-beam cross-bar and rear cross brace defining a plane and a pair of piston guards above the plane attached to the front cross-beam and effective for substantially preventing contact between the tilt adjusting piston and a vehicle which the bucket and assembly are pivoted on the ears and raised;

(c) a pair of mounting ears attached to the rear cross-brace and spacially oriented to pivotally connect with an attachment means on a vehicle;

(d) a bucket control assembly comprised of a tilt adjusting piston mounted on the H-frame and pivotally attached to the rear surface of the bucket, and activating means for activating the piston; and (e) a height adjusting piston for pivoting the bucket and H-assembly on said ears.

* * * * *